US005611218A

United States Patent [19]

Naumovitz

[11] Patent Number: 5,611,218

[45] Date of Patent: Mar. 18, 1997

[54] NITROGEN GENERATION METHOD AND APPARATUS

[75] Inventor: Joseph P. Naumovitz, Lebanon, N.J.

[73] Assignee: The BOC Group, Inc., New Providence, N.J.

[21] Appl. No.: 573,838

[22] Filed: Dec. 18, 1995

[51] Int. Cl.[6] ..... F25J 3/00

[52] U.S. Cl. ..... 62/646; 62/912

[58] Field of Search ..... 62/646, 912

[56] References Cited

U.S. PATENT DOCUMENTS

| | | | |
|---|---|---|---|
| 3,339,370 | 9/1967 | Streich et al. | 62/912 |
| 3,370,435 | 2/1968 | Arregger | 62/912 |
| 4,375,367 | 3/1983 | Prentice | 62/912 |
| 4,655,809 | 4/1987 | Shenoy | 62/646 |
| 5,006,137 | 4/1991 | Agrawal et al. | 62/646 |
| 5,275,003 | 1/1994 | Agrawal et al. | 62/646 |
| 5,311,744 | 5/1994 | Sweeney et al. | 62/646 |

*Primary Examiner*—Ronald C. Capossela

*Attorney, Agent, or Firm*—David M. Rosenblum; Larry R. Cassett

[57] ABSTRACT

A method and apparatus for generating nitrogen from the separation of air in a single column nitrogen generator. Nitrogen rich vapor is condensed to form reflux through the vaporization of an oxygen-rich liquid stream produced as column bottoms. The vaporized oxygen-rich stream is in part recompressed in a recycle compressor, cooled and reintroduced back into the column to increase nitrogen production. The vaporized oxygen-rich stream is also in part expanded with the performance of work. The work of expansion is applied to the compression. A supplemental refrigerant stream produced by a nitrogen liquefaction unit allows the nitrogen to be taken as a liquid and increases the amount of work of expansion able to be applied to the compression.

8 Claims, 2 Drawing Sheets

NITROGEN GENERATION METHOD AND APPARATUS

BACKGROUND OF THE INVENTION

The present invention relates to a nitrogen generation method and apparatus in which air is separated in a distillation column into nitrogen-rich vapor and oxygen-rich liquid fractions. More particularly, the present invention relates to such a method and apparatus in which oxygen-rich liquid, vaporized within a head condenser, is recompressed and reintroduced into the column and also, is in part, expanded with the performance of work which is in turn applied to the recompression. Still, even more particularly, the present invention relates to such a method and apparatus in which an auxiliary refrigerant stream is utilized to increase the amount of the work of expansion that can be applied to the recompression of the vaporized oxygen-rich liquid.

There are numerous prior art processes and apparatus in which air is distilled in a distillation column to produce a nitrogen-rich vapor which is taken as a product. In one type of air separation process and apparatus employing a single distillation column, air, after having been filtered, compressed and purified, is cooled in a main heat exchanger to a temperature suitable for its rectification. Thereafter, the air is introduced into the single column and separated into nitrogen-rich vapor and oxygen-rich liquid fractions. In order to reflux the column, a head condenser is employed in which oxygen-rich liquid is used to condense nitrogen-rich vapor. The vaporized oxygen-rich liquid is then recompressed and re-introduced into the column in order to increase nitrogen production. This compression can take place at a temperature of either the warm or cold ends of the main heat exchanger. Part of the vaporized rich liquid can be partially heated and then expanded with a performance of work. It would seem inviting to apply all this work of expansion to recompression of the vaporized rich liquid. However, for the case where compression occurs at the temperature of the cold end of the main heat exchanger, a heat of compression is produced which would have to be dissipated within the main heat exchanger. The end result would be that no net refrigeration would be made. Thus, a great proportion of the work of expansion must be rejected from the plant by way of an energy dissipative brake.

Typically, such plants as have been described above, make their entire product as a gas. In order to convert the product into a liquid, the product gas must be liquified in a separate liquefier. Such liquefaction is not accomplished without increased energy costs. At the same time, if high purity nitrogen is desired, the equipment involved in the liquefaction can act to contaminate the high purity nitrogen produced by the nitrogen generator. Thus, provision must be made for downstream cleaning of the liquid nitrogen if such liquid nitrogen is to be utilized in a high purity application.

As will be discussed, the present invention provides a nitrogen generation method and apparatus in which more of the work of expansion can be applied to the compression to enhance liquid nitrogen production in an energy efficient manner. Additionally, such liquid nitrogen production is accomplished without the use of a downstream liquefier.

SUMMARY OF THE INVENTION

The present invention provides a method of producing nitrogen. The method comprises cooling compressed, purified feed air to a temperature suitable for its rectification.

The compressed, purified feed air is then introduced into a distillation column to produce a nitrogen rich tower overhead of high purity ("high purity" as used herein and in the claims meaning less than 100 ppb of oxygen) and an oxygen-rich liquid as column bottoms. At least part of a nitrogen-rich stream, composed of the nitrogen-rich tower overhead is condensed and part of the resulting condensate is introduced back into the distillation column as reflux. A nitrogen product stream is formed from a remaining part of the resulting condensate. A recycle stream is compressed and then cooled to the temperature suitable for the rectification of the feed air. The recycle stream is introduced into the distillation column to increase recovery of the nitrogen product. A refrigerant stream is expanded with the performance of work to form a primary refrigerant stream. Heat is indirectly exchanged between the primary refrigerant stream and the compressed and purified air. An amount of the work of expansion is applied to the compression of the recycle stream. A supplemental refrigerant stream is vaporized and then reliquefied. The supplemental refrigerant stream is at least partly vaporized by indirect heat exchange between the at least part of the nitrogen-rich stream, thereby to help effect the condensation of the part of the nitrogen-rich stream. Prior to the reliquefaction of the supplemental refrigerant stream, heat is indirectly exchanged between said supplemental refrigerant stream and the compressed and purified air to increase the portion of the work able to be supplied to the compression, over that obtainable had the supplemental refrigeration not been added. This increases the compression and further increases recovery of the nitrogen product.

In another aspect, the present invention provides a nitrogen generator. A main heat exchange means is configured for cooling compressed, purified feed air to a temperature suitable for its rectification. A distillation column is connected to the main heat exchange means to rectify the compressed and purified feed-air and thereby to produce a nitrogen rich tower overhead of high purity and an oxygen-rich liquid column bottoms. A head condenser is connected to the distillation column for condensing at least part of a nitrogen-rich stream composed of the nitrogen-rich tower overhead and for reintroducing part of the resultant condensate back into the distillation column as reflux so that a remaining part of the resulting condensate can be removed as a product stream. A compressor is provided for compressing a recycle stream. A main heat exchange means is interposed between the compressor and the distillation column so that the recycle stream cools to the temperature at which the air is rectified and is introduced into the distillation column to increase recovery of the nitrogen product. A turboexpander is provided for expanding a refrigerant stream with the performance of work to form a primary refrigerant stream. The turboexpander is connected to the main heating exchange means so that the primary refrigerant stream indirectly exchanges heat with the compressed and purified air. A means is provided for coupling the turboexpander to the compressor so that an portion of the work is applied to the compression of the recycle stream. A supplemental refrigerant circuit is provided for circulating a supplemental refrigerant stream vaporized during the circulation. The supplemental refrigerant circuit includes the head condenser and the main heat exchange means. The head condenser is configured such that the supplementary refrigerant stream is at least partly vaporized through indirect heat exchange with the at least part of the nitrogen-rich stream. The main heat exchange means is also configured to indirectly exchange heat between the supplemental refrigerant stream and the compressed and purified air to increase the amount of work able to be supplied to the compression, over that obtainable had the supplemental refrigeration not been added. This increases compression and further increases recovery of the nitrogen product. The supplemental refrigerant circuit also includes a liquefier interposed between the main heat exchange means and the head condenser to re-liquefy the supplemental refrigerant stream after having been vaporized.

The addition of the supplemental refrigerant stream allows more of the work of expansion to go to the compression of the vaporized rich liquid oxygen stream to be reintroduced back into the distillation column. Thus, for a given supply rate of air, more nitrogen will be produced and more nitrogen can be removed from the head condenser as a liquid. As will be discussed, the supplemental refrigerant stream can be a nitrogen stream which adds its supplemental refrigeration to the plant in the main heat exchanger. However, since such stream leaves the main heat exchanger without a high pressure drop, the amount of energy required for re-liquefaction is not as great as if a vaporized nitrogen stream were to be separately liquified in a non-integrated liquefier. Hence, more liquid nitrogen can be produced at an energy savings over the prior art. Additionally, since the nitrogen can be produced at high purity within a nitrogen generator of the present invention, and the liquefier is integrated through indirect heat exchange, there is no contamination to the product that might otherwise occur had the liquefier been integrated to liquefy the nitrogen product, downstream of the nitrogen generator.

BRIEF DESCRIPTION OF THE DRAWINGS

While the specification concludes with claims distinctly pointing out the subject matter that applicant regards as his invention, it is believed that the invention will be better understood when taken in connection with the accompanying drawings, in which:

DETAILED DESCRIPTION

Figure 1:
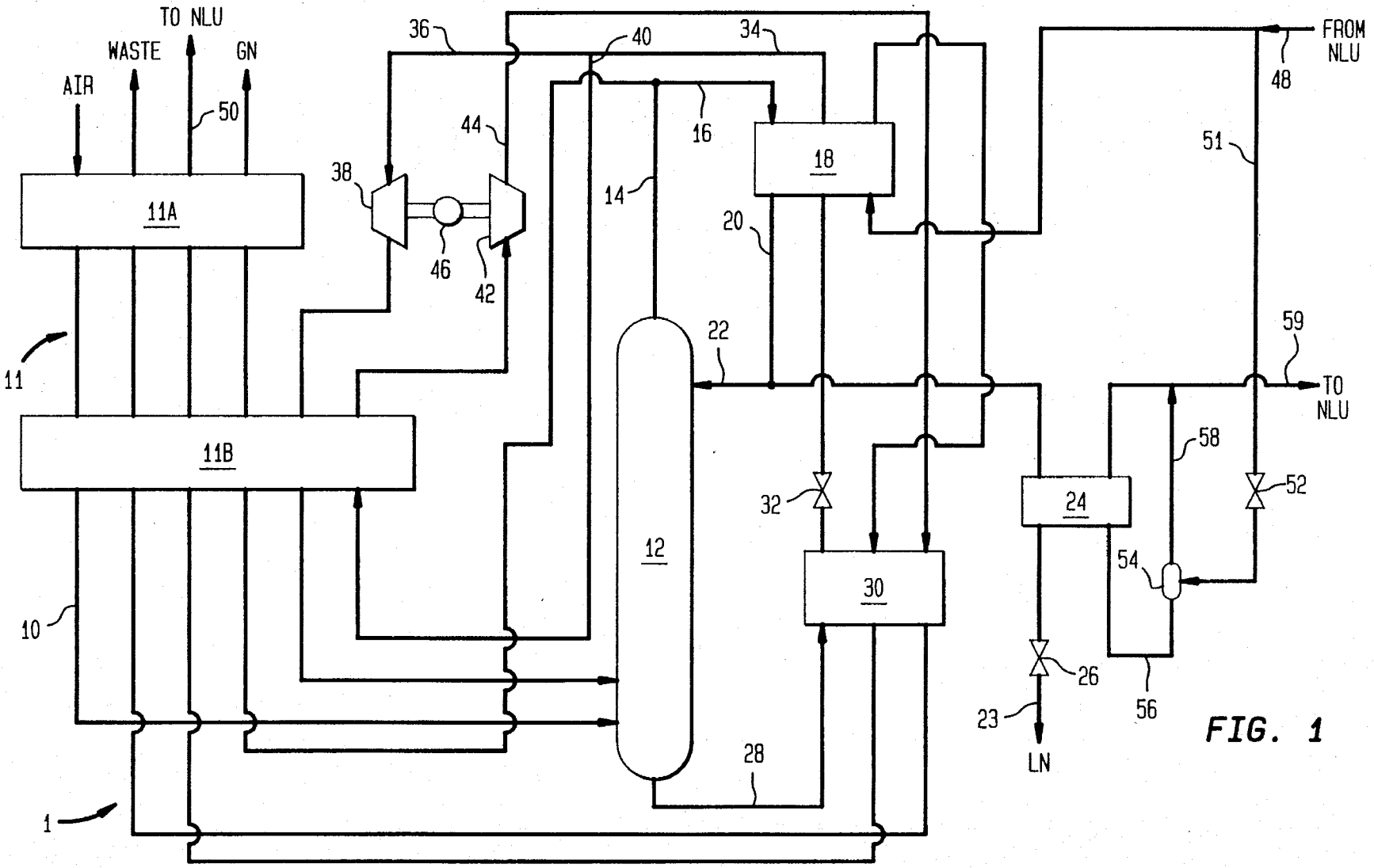
FIG. 1 is a schematic view of a nitrogen generator in accordance with the present invention.

With reference to FIG. 1, a nitrogen generator 1 in accordance with the present invention is illustrated. Air after being filtered to remove dust particles is compressed and then purified to remove carbon dioxide and water. Thereafter, the air is cooled as air stream 10 to a temperature suitable for its rectification within a main heat exchanger 11. Air stream 10 is introduced into a distillation column 12 which is configured to produce an oxygen rich liquid as column bottoms and a high purity nitrogen-rich vapor as tower overhead.

A nitrogen rich stream 14 is produced from the nitrogen-rich vapor. A part 16 of the nitrogen-rich stream 14 is condensed within a head condenser 18 to produce a condensed stream 20. A part 22 of the condensed stream is re-introduced back into distillation column 12. Another part, which in the illustrated embodiment is a remaining part of the condensed stream 20, is extracted as a liquid product stream 23 which preferably after having been subcooled within a subcooling unit 24 is valve expanded by a expansion valve 26 prior to being sent to storage. As would occur to those skilled in the art, a product stream composed of another part of nitrogen rich stream 14 is a possible modification of the illustrated embodiment.

An oxygen rich liquid stream 28 is subcooled with a subcooling unit 30 and is then expanded through an expansion valve 32 to a sufficiently low temperature to effect the condensation of the part 16 of the aforesaid nitrogen-rich stream 14. The oxygen-rich liquid stream 28, after expansion, is introduced into head condenser 18 to produce a vaporized oxygen-rich liquid stream 34.

A part 36 of the vaporized oxygen-rich liquid stream is re-compressed within a recycle compressor 38 and then cooled in Section 11B of main heat exchanger 11 to the temperature of distillation column 12. The now compressed, vaporized oxygen-rich liquid stream is re-introduced into distillation column 12. A remaining part 40 of vaporized oxygen-rich liquid stream 34 is warmed to an intermediate temperature, above the temperature at which the rectification of the air takes place. This occurs within Section 11B of main heat exchanger 11. The remaining part 40 of oxygen-rich liquid stream forms a refrigerant stream which is expanded within a turboexpander 42 to produce a primary refrigerant stream 44. Turboexpander 42 is coupled to compressor 38. Part of the work of expansion is dissipated by an energy dissipative brake 46 or possibly an electrical generator and a remaining part of the energy of expansion is used to power compressor 38. Primary refrigerant stream 44 warms within subcooling unit 30 and then is fully warmed within main heat exchanger 11 where it is discharged from the plant as waste.

It is to be noted that embodiments of the present invention are possible in which a stream of liquid is extracted at a column location above the bottom of the column and then, after vaporization during use in the distillation process, is recompressed, cooled and reintroduced into the column. Additionally, the present invention is not limited to nitrogen generation plants in which a refrigerant stream is formed from vaporized column bottoms liquid.

A supplemental refrigerant stream 48 is supplied from a nitrogen liquefying unit (labelled "NLU") that will be discussed hereinafter. A part 50 of supplementary refrigerant stream 48 is vaporized within head condenser 18 and then is further warmed within subcooling unit 30. Thereafter, it is introduced into main heat exchanger 11 where it is fully warmed and then returned back to the nitrogen liquefying unit. An embodiment of the present invention is possible in which the supplementary refrigerant stream partly vaporizes within head condenser 18 and then goes on to fully vaporize within main heat exchanger 11.

Supplemental refrigeration is thus supplied to nitrogen generator 1. A remaining part 51 of the incoming supplementary refrigerant stream is valve expanded within a valve 52 and then is phase separated within phase separator 54 to produce a liquid stream 56. Liquid stream 56 acts to subcool liquid product stream 23. A vapor stream 58 composed of the vapor phase of the separated supplemental refrigerant is combined with stream 56 and returned to the nitrogen liquefying unit as a stream 59.

Figure 2:
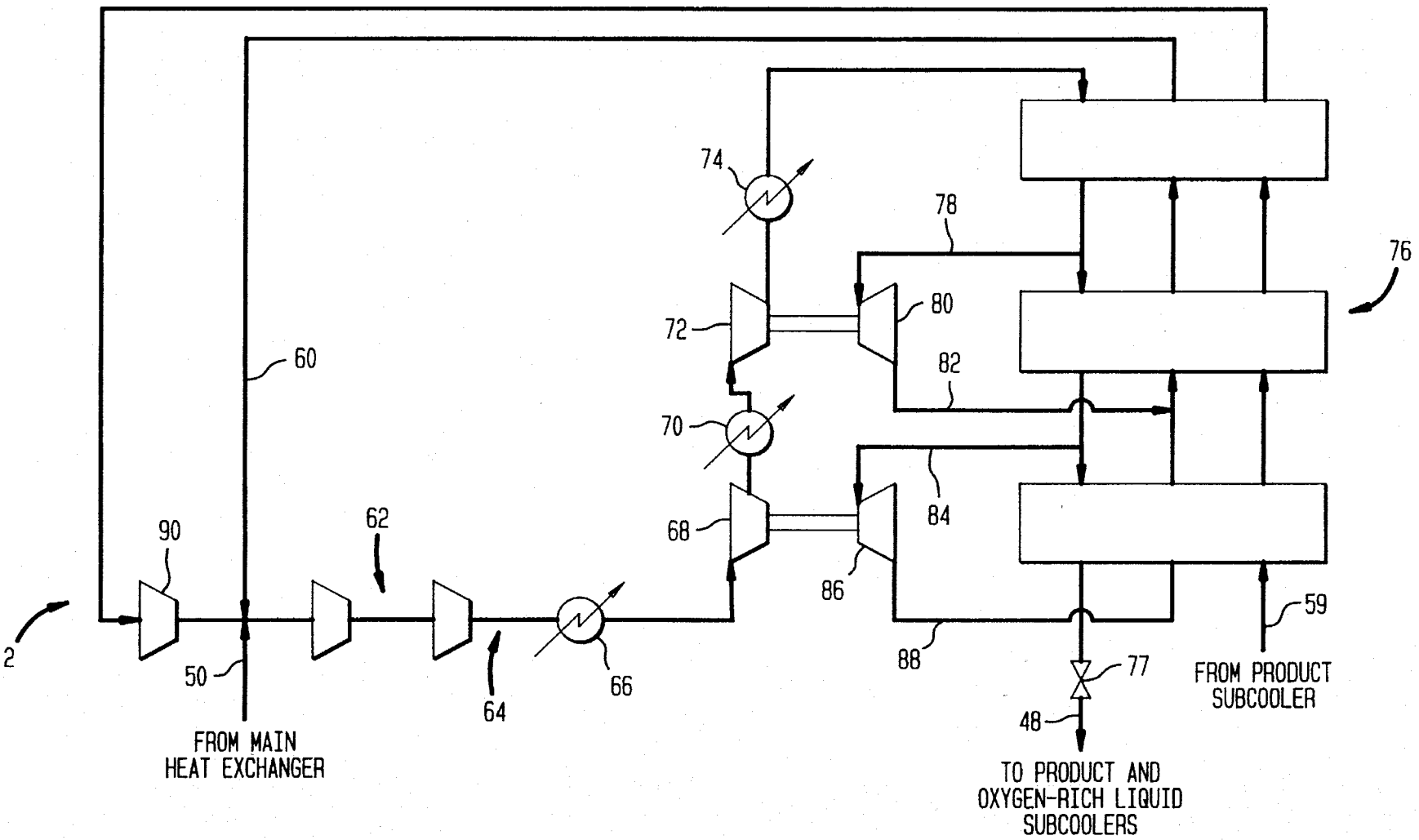
FIG. 2 is a schematic view of a nitrogen liquefier to be integrated into the nitrogen generator illustrated in FIG. 1.

With reference to FIG. 2, a nitrogen liquefying unit 2 in accordance with the present invention is illustrated. Part 50 of supplementary refrigerant stream 48 is combined with a recycle stream 60 and stream 59 after having been warmed in a manner that will be discussed hereinafter. The resultant combined stream is then recompressed within a compression unit 62 to form a compressed stream 64. The heat of compression is removed from compressed stream 64 by an after-cooler 66. Compressed stream 64 is then introduced into a first booster compressor 68 and the heat of compression is removed by a first after-cooler 70. Compressed stream 64 is then introduced into a second booster compressor 72 and the heat of compression is then removed from compressed stream 64 by a second after-cooler 74. Thereafter, the major part of compressed stream 64 is cooled within a heat exchanger 76 and valve expanded to liquefaction by valve 77 to produce supplementary refrigerant stream 48.

After compressed stream 64 has partly cooled within heat exchanger 76, a subsidiary stream 78 is separated from compressed stream 64. Subsidiary stream 78 is expanded within a first turboexpander 80 linked to second booster compressor 72 to produce an expanded stream 82. After formation of subsidiary stream 78, compressed stream 64 is further cooled and a subsidiary stream 84 is then separated therefrom. Subsidiary stream 84 is expanded within a second turboexpander 86 operating at a lower temperature than that of first turboexpander 80. Second turboexpander 86 is linked to first compressor booster 68. The resultant expanded stream 88 is then partly warmed within heat exchanger 76 and combined with expanded stream 82 to form recycle stream 60. Recycle stream 60 is fully warmed within main heat exchanger 76 prior to its combination with the part 50 of supplemental refrigerant stream 48 that enters liquefying unit 2. Stream 59 also fully warms within heat exchanger unit 76 and is then compressed in a compressor 90 to enable it to also combine with part 50 of supplemental refrigerant stream 48.

As will be understood by those skilled in the art, although the present invention has been described with reference to a preferred embodiment, numerous changes, additions and omissions may be made without departing from the spirit and scope of the present invention.

I claim:

1. A method of producing nitrogen, said method comprising:

cooling compressed, purified feed air to a temperature suitable for its rectification;

introducing said compressed, purified feed air into a distillation column to produce a nitrogen rich tower overhead of high purity and oxygen-rich liquid as column bottoms;

condensing at least part of a nitrogen-rich stream composed of said nitrogen-rich tower overhead and introducing part of the resulting condensate into said distillation column as reflux;

forming a nitrogen product stream from a remaining part of the resulting condensate;

compressing a recycle stream, cooling said recycle stream to said temperature and introducing said recycle stream into said distillation column to increase recovery of said nitrogen product;

expanding a refrigerant stream with the performance of work to form a primary refrigerant stream and indirectly exchanging heat between said primary refrigerant stream and said compressed and purified air and said recycle stream;

applying an amount of said work to said compression of said recycle stream;

vaporizing and then reliquefying a supplemental refrigerant stream;

said supplemental refrigerant stream being at least partly vaporized by indirectly exchanging heat with said at least part of said nitrogen-rich stream, thereby to help effect said condensation of said part of said nitrogen-rich stream; and prior to said reliquefaction of said supplemental refrigerant stream, indirectly exchanging heat between said supplemental refrigerant stream and said compressed and purified air and said recycle stream to increase said amount of said work able to be applied to said compression, over that obtainable had said supplemental refrigeration not been added, thereby to increase compression and to further increase recovery of said nitrogen product.

2. The method of claim 1, wherein:

a stream of said oxygen-rich liquid is withdrawn from said distillation column, valve expanded, and passed in indirect heat exchange with said nitrogen-rich stream to help condense said at least part of said nitrogen-rich stream and thereby to form a vaporized oxygen-rich stream;

said recycle stream is formed from part of said vaporized oxygen-rich stream; and said refrigerant stream is formed from a remaining part of said vaporized oxygen-rich liquid stream.

3. The method of claim 2, wherein said supplemental refrigerant stream is completely vaporized by said indirect heat exchange with said nitrogen-rich tower overhead.

4. The method of claim 3, wherein said supplemental refrigerant stream is liquefied by compressing said supplemental refrigerant stream and expanding said supplemental refrigerant stream at two temperature levels.

5. The method of claim 2, wherein:

said nitrogen product comprises part of said condensate and is divided into two product streams;

one of said product streams is vaporized through indirect heat exchange with said compressed and purified air;

the other of said product streams is subcooled through indirect heat exchange with a subsidiary stream composed of part of said supplemental refrigerant stream; and said subsidiary stream is combined with a remaining part of said supplemental refrigerant stream prior to liquefaction.

6. A nitrogen generator comprising:

main heat exchange means configured for cooling compressed, purified feed air to a temperature suitable for its rectification;

a distillation column connected to said main heat exchange means to rectify said compressed and purified feed air and thereby to produce a nitrogen rich tower overhead of high purity and oxygen-rich liquid as column bottoms;

a head condenser connected to said distillation column for condensing at least part of a nitrogen-rich stream composed of said nitrogen rich tower overhead and for reintroducing part of the resultant condensate back into said distillation column as reflux so that a remaining part of the resultant condensate can be removed as a product stream;

a compressor for compressing a recycle stream;

said main heat exchange means interposed between said compressor and said distillation column so that said recycle stream cools to said temperature and is introduced into said distillation column to increase recovery of said nitrogen product;

a turboexpander for expanding a refrigerant stream with performance of work to form a primary refrigerant stream;

said turboexpander connected to said main heat exchange means so that said primary refrigerant stream indirectly exchanges heat with said compressed and purified air;

means for coupling said turboexpander to said compressor so that an amount of said work is applied to said compression of said recycle stream; and a supplemental refrigerant circuit for circulating a supplemental refrigerant stream vaporized during the circulation, said supplemental refrigerant circuit including, said head condenser, said head condenser configured such that said supplementary refrigerant stream is at least party vaporized through indirect heat exchange with said at least part of the nitrogen-rich stream, said main heat exchange means, said main heat exchange means also configured to indirectly exchange heat between a supplemental refrigerant stream and said compressed and purified air to increase said amount of said work able to be applied to said compression, over that obtainable had said supplemental refrigeration not been added, thereby to increase compression and to further increase recovery of said nitrogen product, and a liquefier interposed between said main heat exchange means and said head condenser to re-liquefy said supplemental refrigerant stream after having been vaporized.

7. The nitrogen generator of claim 6, further comprising:

said head condenser also configured to indirectly exchange heat with a stream of said oxygen-rich liquid;

an expansion valve interposed between said head condenser and said distillation column for valve expanding said stream of said oxygen-rich liquid, thereby to form a vaporized oxygen rich stream;

said compressor and turboexpander connected to said head condenser so that said recirculation stream comprises part of said vaporized oxygen-rich liquid stream and said refrigerant stream comprises a remaining part of said vaporized oxygen rich liquid stream.

8. The nitrogen generator of claim 6, wherein supplemental refrigerant stream liquefier comprises a nitrogen liquefier having two turboexpanders operating at two different temperature levels.

* * * * *